US008240287B2

(12) United States Patent
Hashimoto et al.

(10) Patent No.: US 8,240,287 B2
(45) Date of Patent: Aug. 14, 2012

(54) OPERATION MANAGEMENT APPARATUS

(75) Inventors: Shoji Hashimoto, Wako (JP); Ryuichi Kimata, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 430 days.

(21) Appl. No.: 12/704,072

(22) Filed: Feb. 11, 2010

(65) Prior Publication Data

US 2010/0211285 A1 Aug. 19, 2010

(30) Foreign Application Priority Data

Feb. 18, 2009 (JP) ..... 2009-035524

(51) Int. Cl.
*F01M 11/10* (2006.01)
*G04F 8/00* (2006.01)

(52) U.S. Cl. ..... 123/196 S; 701/115; 368/5

(58) Field of Classification Search ..... 701/101, 701/114, 115; 368/5, 6, 8; 123/196 S, 198 D
See application file for complete search history.

(56) References Cited

U.S. PATENT DOCUMENTS

| | | | | |
|---|---|---|---|---|
| 4,181,883 | A | 1/1980 | Beeghly | |
| 5,121,368 | A * | 6/1992 | Polydoris et al. | 368/9 |
| 5,337,003 | A * | 8/1994 | Carmichael et al. | 324/402 |
| 7,154,814 | B2 * | 12/2006 | Straka | 368/5 |
| 7,692,409 | B2 * | 4/2010 | Schaper et al. | 320/157 |
| 7,944,706 | B2 * | 5/2011 | Fujino | 361/760 |
| 2007/0069521 | A1 | 3/2007 | Jabaji | |

FOREIGN PATENT DOCUMENTS

| | | |
|---|---|---|
| JP | 11-311149 | 11/1999 |
| JP | 2005-299532 | 10/2005 |
| JP | 2005-343191 | 12/2005 |

* cited by examiner

*Primary Examiner* — Thomas Moulis
(74) *Attorney, Agent, or Firm* — Rankin, Hill & Clark LLP

(57) ABSTRACT

Operation management apparatus includes a control section for controlling operation of an internal combustion engine, a storage section for storing data of an integrated operating time of the engine monitored by the control section, and a display section capable of displaying not only operating states of the engine but also an integrated operating time of the internal combustion engine. The control section controls the display section to make a blinking display with a predetermined number of blinks, corresponding to the integrated operating time, at predetermined timing.

7 Claims, 9 Drawing Sheets

OPERATION MANAGEMENT APPARATUS

FIELD OF THE INVENTION

The present invention relates to an operation management apparatus capable of displaying an accumulated or integrated operating time of an internal combustion engine used, for example, for a portable inverter-type power generator having a utility or general-purpose engine.

BACKGROUND OF THE INVENTION

General-purpose engines or power generators provided with a general-purpose engine include an analog hour meter or a digital hour meter, comprising for example a liquid crystal display or seven segment LEDs (Light Emitting Diode), that counts engine ignition pulses in order to indicate an integrated operating time of the engine that is important for purposes of maintenance including engine oil change. Such general-purpose engines or power generators also include display lights that indicate various operating states, such as a power generating state, overload, power generation control system error and oil warning.

Heretofore, many patent applications have been filed for techniques which display operating states for maintenance purposes on general-purpose engines or power generators having a general-purpose engine. For example, Japanese Patent Application Laid-Open Publication No. 2005-343191 (JP 2005-343191 A) discloses a motive power vehicle which includes a liquid crystal display section and warning lights provided on an instrument panel. Further, Japanese Patent Application Laid-Open Publication No. HEI-11-311149 (JP H11-311149 A) discloses an engine management apparatus which stores and displays operating states of an engine, such as an operating time at the time of generation of a warning. Furthermore, Japanese Patent Application Laid-Open Publication No. 2005-299532 OP 2005-299532 A) discloses an engine failure history display apparatus which displays a recorded failure history each time a predetermined push button is operated by a human operator or user and which erases a previously recorded failure history when an engine stop switch and the push button have been operated simultaneously by the user.

However, because it is necessary to provide an hour meter and/or a display device dedicated to displaying of a failure history in addition to the output, indication lights, application of the conventionally-known techniques to a compact product, such as a portable inerter-type power generator, would be disadvantageous in terms of cost reduction. Further, the conventionally-known techniques would limit the layout and design freedom of the general-purpose engine or power generator.

Further, if a dedicated diagnosis tool usually possessed by a service person is used, it may be possible to check desired information pertaining to an integrated operating time by reference to a memory of an inverter unit provided in the general-purpose engine. However, because the dedicated diagnosis tool must be used, cumbersome operation would be required. Therefore, there has been a demand for a technique for allowing a user to readily visually recognize an integrated operating time of the engine.

SUMMARY OF THE INVENTION

In view of the foregoing prior art problems, it is an object of the present invention to provide a technique which can readily inform a user of an accumulated or integrated operating time of an internal combustion engine without requiring additional equipment.

In order to accomplish the above-mentioned object, the present invention provides an improved operation management apparatus for managing an integrated operating time of an internal combustion engine, which apparatus comprises: a control section for controlling operation of the internal combustion engine; a storage section for storing data of the integrated operating time of the internal combustion engine monitored by the control section; and a display section capable of displaying not only an operating state of the internal combustion engine but also the integrated operating time of the internal combustion engine, the control section controlling the display section to make a blinking display with a predetermined number of blinks, corresponding to the integrated operating time, at predetermined timing.

In the operation management apparatus of the present invention, the control section monitors an operating time of the internal combustion engine, acquires data of the integrated operating time of the internal combustion engine and causes the display section to display the data of the integrated operating time with a number of blinks corresponding to the integrated operating time. Namely, the display section is capable of displaying not only the operating state of the internal combustion engine but also the integrated operating time of the internal combustion engine. Thus, the operation management apparatus of the present invention can appropriately inform a human operator or user of the integrated operating time without requiring extra or additional equipment. Further, because there is no need to provide a separate member for informing the integrated operating time, the present invention not only can reduce cost of the apparatus (particularly the internal combustion engine), but also can avoid design limitations of the apparatus (particularly the internal combustion engine).

Preferably, after the display section has made the blinking display, the control section controls the display section to switch from the blinking display to a display of the operating state of the internal combustion engine. Thus, the user does not have to perform any particular operation for switching the display, and thus, the present invention can enhance usability of the operation management apparatus.

Preferably, the predetermined timing at which the control section causes the display section to make the blinking display is a time point when the internal combustion engine is activated. By the control section causing the display section to blinkingly display data of an integrated operating time of the engine at the time of activation of the engine, the user can determine, at the time of activation of the engine, when maintenance, such as oil change, is to be performed, and thus, user-friendliness of the operation management apparatus of the present invention can be enhanced.

Preferably, a power generator is connected to the internal combustion engine, and the predetermined timing at which the control section causes the display section to make the blinking display is a time point after the power generator starts generating electric power in response to activation of the internal combustion engine and the control section starts operating by being supplied with the electric power from the power generator. By the control section causing the display section to blinkingly display data of an integrated operating time of the engine immediately after electric power necessary for operation of the control section is secured and the control section starts operating at the time of activation of the engine, the present invention can accurately inform the user of the integrated operating time of the engine. Thus, the present invention can inform the user of an integrated operating time of the engine with an enhanced reliability.

Preferably, the predetermined timing at which the control section causes the display section to make the blinking display is a time point when the internal combustion engine is deactivated. By the control section causing the display section to blinkingly display data of an integrated operating time of the internal combustion engine at the time of deactivation of the engine, the user can determine when to perform maintenance, such as oil change, at the time of deactivation of the engine. Therefore, as compared to the case where an integrated operating time of the internal combustion engine is displayed only at the time of activation of the engine, maintenance of the engine can be performed at proper timing (based on the latest information of the integrated operating time) with an enhanced efficiency.

Preferably, a power generator is connected to the internal combustion engine, and the predetermined timing at which the control section causes the display section to make the blinking display is during a time period when the power generator is generating electric power necessary for operation of the control section after the internal combustion engine receives an engine stop instruction. By the control section causing the display section to blinkingly display data of an integrated operating time immediately after electric power necessary for operation of the control section is secured and the control section stops operating at the time of deactivation of the engine, the control section can accurately inform the user of an integrated operating time of the engine. Thus, the present invention can inform the user of an integrated operating time with an enhanced reliability.

Preferably, the predetermined timing at which the control section causes the display section to make the blinking display is at least one time point during a time period from the time point when the internal combustion engine is activated to the time point when the internal combustion engine is deactivated. By the control section causing the display section to blinkingly display data of an integrated operating time at a predetermined time point during the time period from the activation to deactivation of the engine, the user can determine when to perform maintenance, such as oil change, during operation of the internal combustion engine. Thus, in this case, the present invention can achieve an even further enhanced flexibility and user-friendliness of the apparatus than in the case where an integrated operating time of the internal combustion engine is displayed only at the time of activation of the engine or only at the time of deactivation of the engine.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Embodiment 1

Figure 1:
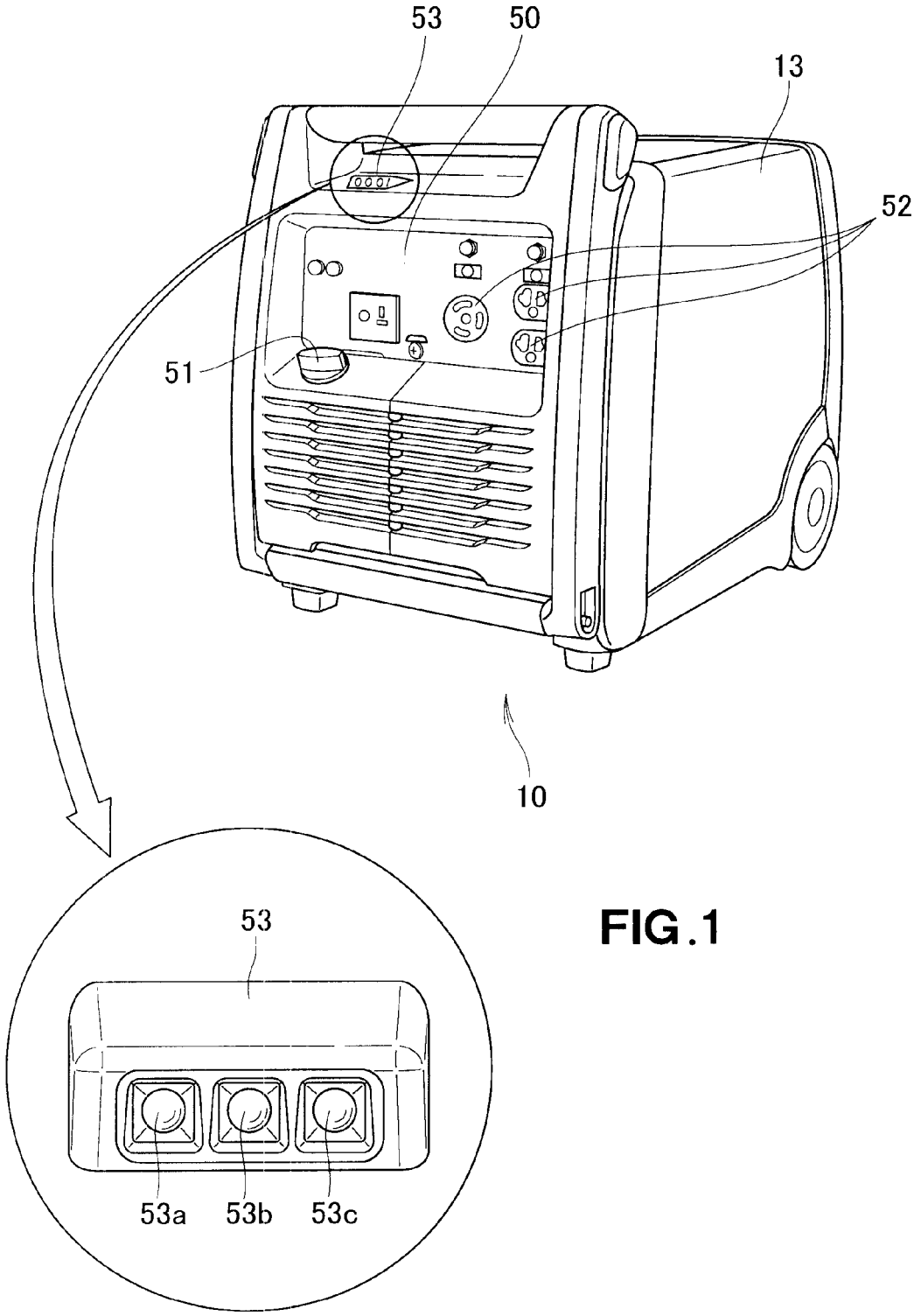
FIG. 1 is a perspective view showing an outer appearance of a portable engine power generator provided with a first embodiment of an operation management apparatus of the present invention.
Figure 2:
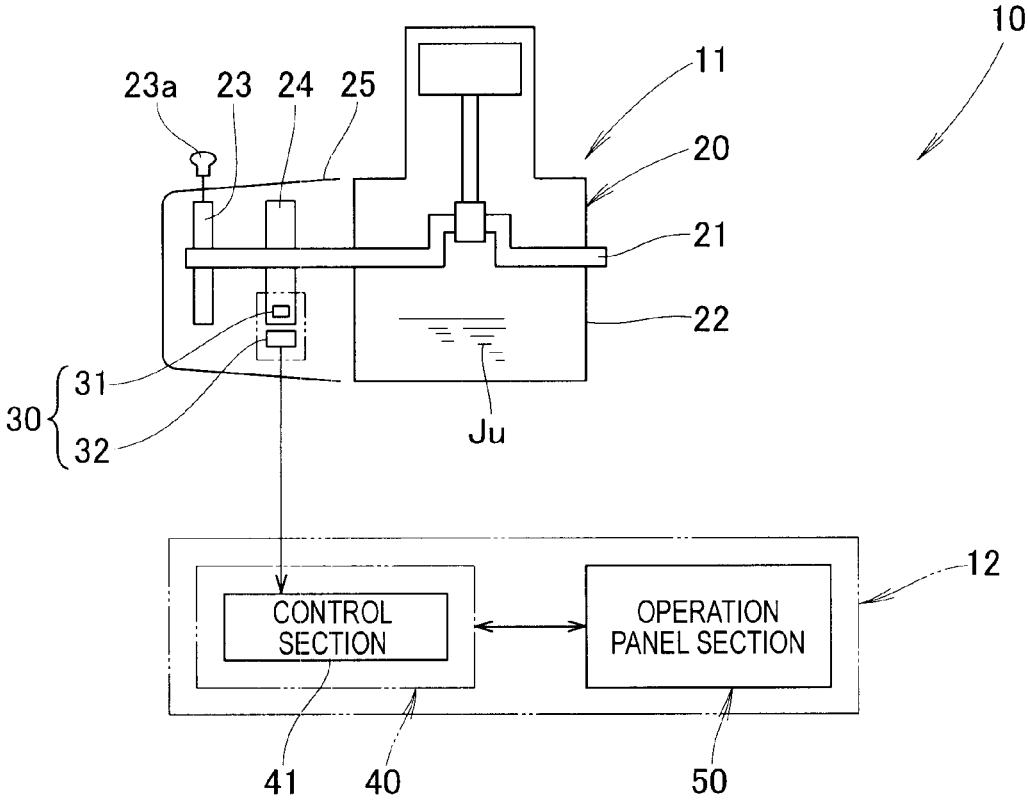
FIG. 2 is a block diagram schematically showing a general setup of the portable engine power generator of FIG. 1.

Reference is now made to FIG. 1 showing in perspective an outer appearance of a portable engine power generator 10 provided with a first embodiment of an operation management apparatus of the present invention, and to FIG. 2 showing in block diagram a general setup of the portable engine power generator 10.

As shown in FIG. 2, the portable engine power generator 10 includes an engine power generation unit 11 and the operation management apparatus 12, and it is accommodated in a case 13 (FIG. 1). The engine power generation unit 11 includes a general-purpose engine 20 and a power generator 30.

The engine 20 is a lubricating-type internal combustion engine which includes a substantially horizontal crankshaft 21 and a recoil starter 23, and in which various sliding portions are lubricated with oil Ju stored in a crankcase 22.

The recoil starter 23 is a device manually operable by a human operator or user for activating the engine 20, and it is mounted, for example, at a leading end of the crankshaft 21 or a flywheel directly connected to the crankshaft 21.

The power generator 30 is a multi-pole alternator for generating A.C. electric power using an output of the engine 20, and it includes, for example, a permanent magnet 31 provided on the flywheel 24 and a coil 32 located adjacent to the permanent magnet 31.

The engine 20 can be activated by the human operator pulling a knob 23*a* of the recoil starter 23, in response to which the power generator (multi-pole alternator) 30 starts generating three-phase A.C. electric power. The power generated by the power generator 30 is first rectified via an inverter provided in the operation management apparatus 12 and then output after being re-converted into A.C. electric power of a sine wave having the same frequency as a high-quality commercial power supply. Note that the recoil starter 23 and the power generator 30 are covered with a cover 25.

Figure 3:
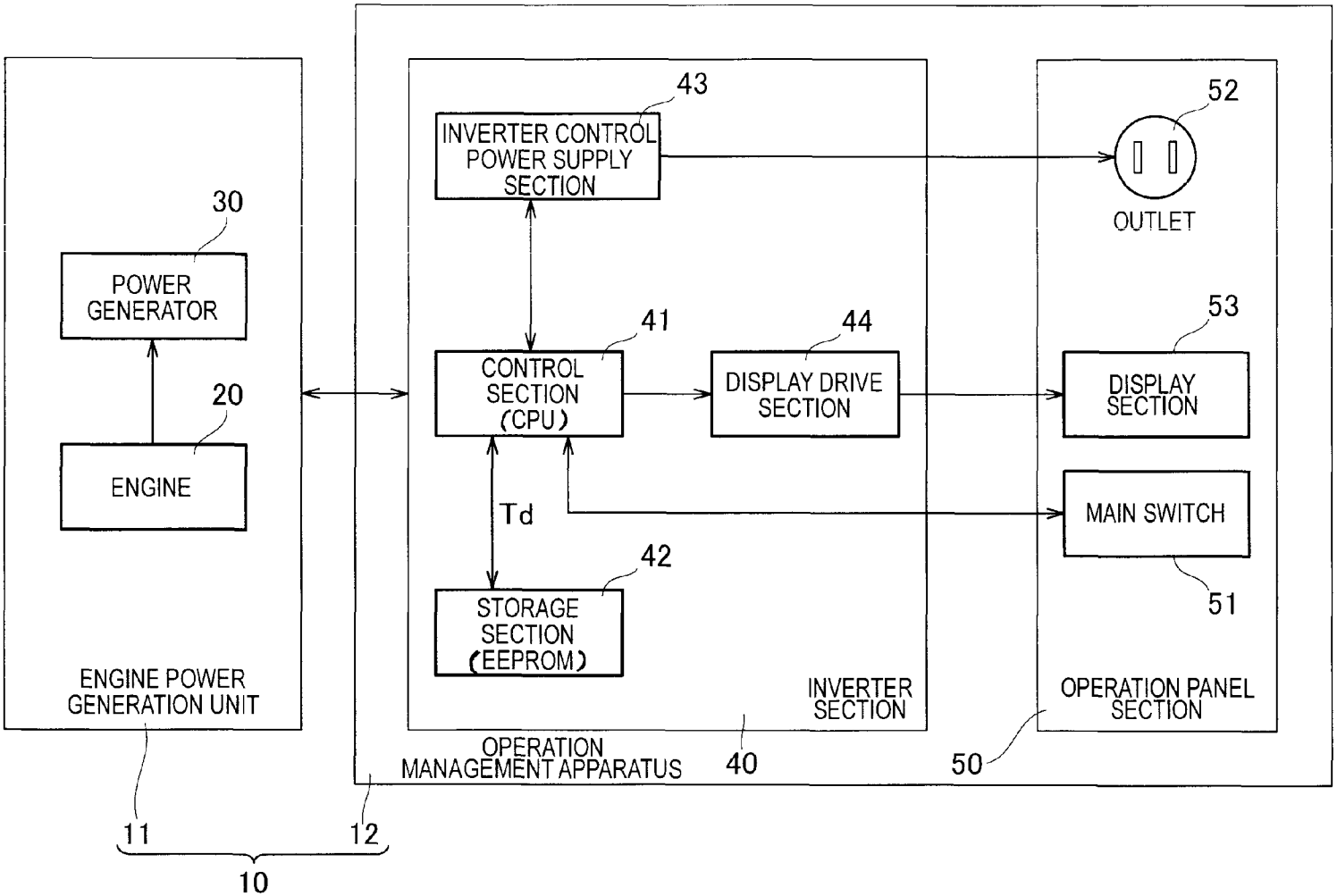
FIG. 3 is a block diagram showing an inner construction of the operation management apparatus of FIG. 2.

FIG. 3 is a block diagram showing an inner construction of the first embodiment of the operation management apparatus 12. As shown in FIGS. 2 and 3, the operation management apparatus 12 includes an inverter section 40 and an operation panel section 50. The inverter section 40 includes a control section 41, a storage section 42, an inverter control power supply section 43 and a display drive section 44.

The control section 41, which comprises, for example, a microprocessor (CPU), reads out a program from a program memory provided in, or externally attached to, the control section 41 and controls the engine power generation unit 11 on the basis of the read-out program.

Under the control of the read-out program, the control section 41 also reads out, from the storage section 42, data of an accumulated or integrated operating time Td at predetermined timing and controls a display section 53 via the display drive section 44 to make a blinking display with a predetermined number of blinks corresponding to the read-out integrated operating time Td. The integrated operating time Td is an integrated value of time for which the engine 20 has been operated substantively. The predetermined timing is an engine activation time point when the engine 20 is activated (i.e., caused to start operating), an engine deactivation time point when the engine 20 is deactivated (i.e., caused to stop operating), and at least one suitable time point during a time period from the engine activation time point to the engine deactivation time point.

The storage section 42 is, for example, in the form of a nonvolatile memory, such as an EEPROM (Electrically Erasable PROM), in which data of an integrated operating time Td is stored under control of the control section 41. The inverter control power supply section 43 rectifies electric power, generated by the power generator 30 A.C., into D.C. electric power, then re-converts the D.C. electric power into A.C. electric power of a sine wave having the same frequency as a high-quality commercial power supply and then supplies the A.C. electric power to an outlet 52. The display drive section 44 is in the form of an IC that, drives the display section 53.

The operation panel section 50 includes a main switch 51, the outlet 52 and the display section 53. The main switch 51 is a rotary switch for turning on/off a power supply to the engine 20. Namely, the engine 20 can be activated by the human operator operating the main switch 51 from an OFF position to an ON position and can be deactivated by the human operator operating the main switch 51 from the ON position to the OFF position. The outlet 52 is a terminal that is provided on the operation panel 50 and outputs the electric power generated by the power generator 30.

The display section 53, which is provided on the operation panel 50, displays operating states of the engine 20 and power generator 30. As shown in FIG. 1, the display section 53 includes three (i.e., first to third) display sections 53*a*-53*c* each in the form of an LED (Light Emitting Diode). The first display section 53*a* functions as an output display light for indicating an output state of the power generator 30. The second display section 53*b* functions as an overload warning light for indicating overload states of the engine 20 and power generator 30. The third display section 53*c* functions as an oil warning light for indicating that the oil Ju stored in the engine 20 has decreased to a lower limit value.

Next, a description will be given about an example sequence of operations performed from a time point when the human operator has activated the engine 20 to a time point when the control section 41 performs display control processing, with reference to FIG. 4 in conjunction with FIGS. 1-3.

First, the human operator turns on the main switch 51 at step S01 and then activates the recoil starter 23 by pulling the knob 23*a* of the recoil starter 23 at step S02. Thus, the engine 20 is activated at step S03, in response to which the power generator 30 starts generating electric power at step S04. Then, once the output voltage of the power generator 30 reaches a stable level greater than a predetermined level, the control section 41 and the inverter control power supply section 43 are automatically activated by the electric power supplied from the power generator 30, at step S05. Then, initialization of the CPU of the control section 41 is executed at step S06. The "initialization" of the CPU includes zero-clearing of registers incorporated in the control section 41, diagnosing of connection ports, etc. Following the initialization, the control section 41 performs the display control processing at step S07 as a subroutine that is detailed below with reference to FIG. 5.

Figure 4:
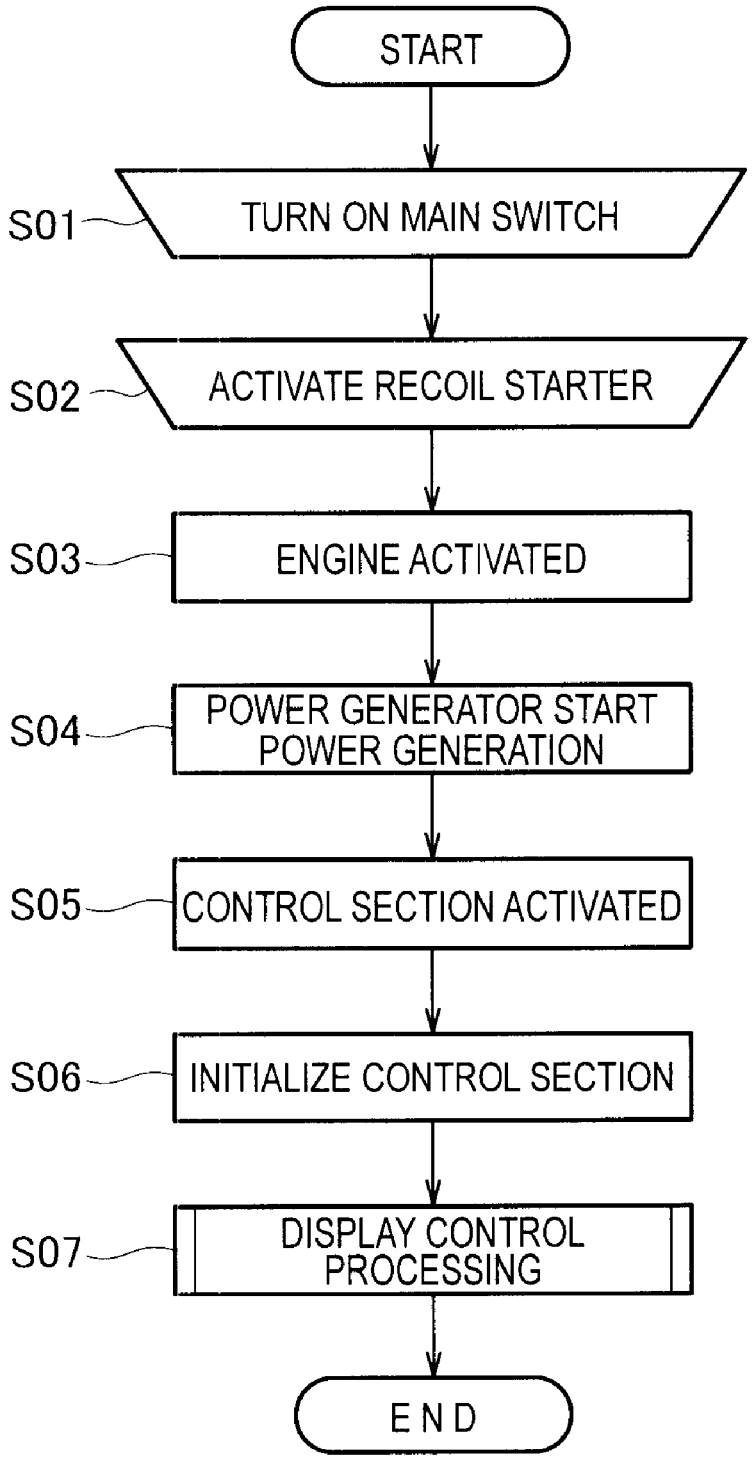
FIG. 4 is a flow chart showing an example sequence of operations performed from a time point when a human operator activates an engine to a time point when a control section completes display control processing.
Figure 5:
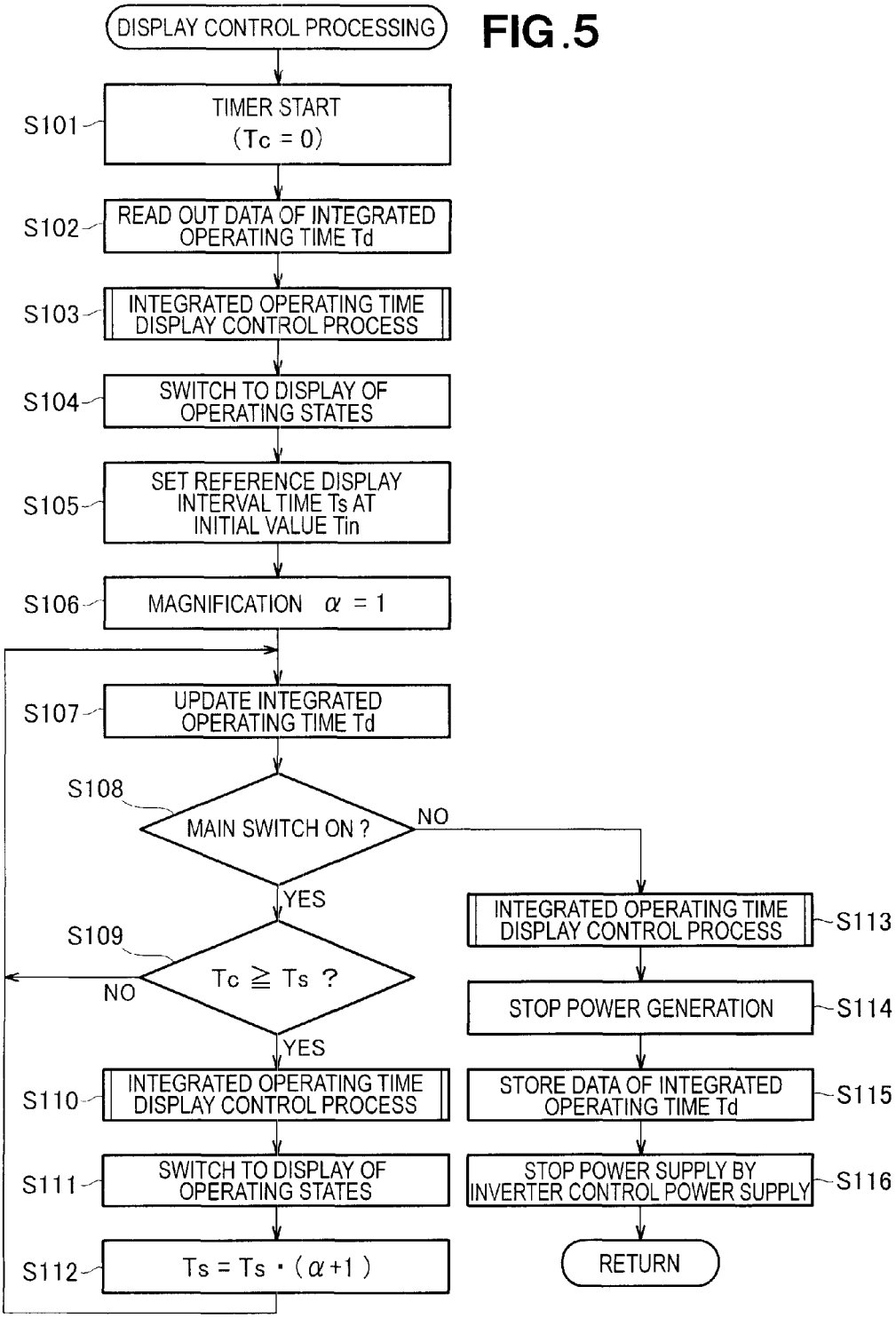
FIG. 5 is a flowchart showing a subroutine for performing the display control processing of FIG. 4.

FIG. 5 is a flowchart showing the display control processing subroutine performed at step S07 of FIG. 4. In the display control processing subroutine of FIG. 5, a time Tc set in an internal timer (not shown) is reset to "0" and the internal timer is caused to start counting time at step S101, so that monitoring of the integrated operating time Td (i.e., hour meter value Td) of the engine 20 is started. The "integrated operating time Td" is an accumulated or integrated value of time for which the engine 20 has operated so far. Then, data of the last integrated operating time Td is read out from the storage section 42 at step S102. The "last integrated operating time Td" (i.e., last hour meter value Td) is data of the integrated operating time Td stored into the storage section 42 immediately before the engine 20 was deactivated last.

Then, at step S103, an integrated operating time display control process is performed. Namely, the first control portion 53*a* is controlled to make a blinking display with a predetermined number of blinks corresponding to the last integrated operating time Td read out at step S102. Control of this blinking display is performed as a subroutine that will be described later in relation to FIG. 6. Then, the first control portion 53*a* is switched to an ordinary display mode for displaying ordinary operating states of the engine 20 at step S104; namely, after the blinking display, the first control portion 53*a* functions as an ordinary output display light.

Next, at step S105, a reference display interval time Ts is set at a predetermined initial value Tin (i.e., Ts=Tin). The initial value Tin is set in advance in accordance with operating characteristics and use conditions of the engine 20. The initial value Tin is preset, for example, at two minutes, fifteen minutes, one hour or the like. Then, a magnification a is set at a value "1" (i.e., $\alpha=1$); the magnification $\alpha$ is used for increasing the value of the reference display interval time Ts.

Then, at step S107, the value of the integrated operating time Td is updated. Namely, the value of the integrated operating time Td read out at step S102 above is updated with a time Tc at a time point when the operation of step S107 is performed. Then, a determination is made, at step S108, as to whether the main switch 51 is currently ON. If the main switch 51 is currently ON as determined at step S108 (i.e., YES determination at step S108), it is further determined, at step S109, whether the time Tc counted by the timer has reached the reference display interval time Ts. If the time Tc has not yet reached the reference display interval time Ts ($Tc<Ts$) as determined at step S109, the operations of steps S107 to S109 are repeated until the time value Tc reaches the reference display interval time Ts.

Once the time Tc reaches the reference display interval time Ts as determined at step S109, the first control portion 53*a* is controlled, at step S110, to make a blinking display with a predetermined number of blinks corresponding to the integrated operating time Td updated at step S107. Control of this blinking display is performed as the subroutine that will be described later in relation to FIG. 6. Then, the first control portion 53*a* is switched to the ordinary display mode for displaying ordinary operating states of the engine 20, at step S111; namely, the first control portion 53*a* functions as the ordinary output display light.

Then, the value of the reference display interval time Ts is incremented by a predetermined value at step S112. Namely, the value of the magnification $\alpha$ is incremented by one, and the reference display interval time Ts is multiplied by the thus-incremented value of the magnification α to thereby provide a new value of the reference display interval time Ts (Ts=Ts·(α+1)). In this way, the value of the reference display interval time Ts multiplicatively increases, i.e. twofold, threefold, . . . , or the like, each time the operation of step S112 is performed. After step S107, control reverts to step S107.

Namely, as long as the main switch 51 is kept in the ON state, the control section 41 causes the first control portion 53*a* to make a blinking display with a predetermined number of blinks corresponding to the updated integrated operating time Td each time the reference display interval time Ts elapses after the timer stars.

Once the main switch 51 is turned off by the user during operation of the engine 20, it is determined, at step S108, that the main switch 51 is currently OFF. Thus, the first control portion 53*a* is controlled, at step S113, to make a blinking display with a predetermined number of blinks corresponding to the integrated operating time Td updated at step S107 above, as will be described later in relation to FIG. 6.

Next, an operation is performed for stopping the power generation by the power generator 30, at step S114. Data of the integrated operating time Td having been monitored by the control section 41 is stored into a predetermined area of the storage section 42 at step S115, and then an operation is performed for stopping power supply by the inverter control power supply section 43 at step S116. After that, the subroutine of FIG. 5 is brought to an end and control reverts to step S07 of FIG. 4. Note that the operations of steps S113 and S114 may be performed simultaneously.

It is generally known that an engine completely stops after a crankshaft continues to rotate by inertia for a certain time following turning-off of a main switch. The engine 20 in the instant embodiment too completely stops after the crankshaft 21 continues to rotate by inertia for a certain time following turning-off of the main switch 51 (i.e., after the engine 20 receives an engine stop instruction from the control section 41). Namely, some idle running time is required until the engine 20 completely stops. This tendency is strong in the instant embodiment because the flywheel 24 is provided on the crankshaft 21.

In light of the foregoing, the operations of steps S113 to S116 are performed while the power generator 30 are generating electric power necessary for operation of the control section 41 after the engine 20 receives an engine stop instruction.

As apparent from the foregoing, the timing at which the control section 41 causes the first display section 53*a* to make a blinking display with a predetermined number of blinks, corresponding to the integrated operating time Td (i.e., predetermined blinking display timing) is a time point when the engine 20 is started to run (step S103), at least one predetermined time point during a time period from the time point of activation of the engine 20 to a time point when the engine 20 is deactivated (step S110) and the time point of deactivation of the engine 20 (step S113).

Upon arrival at the predetermined blinking display timing, the control section 41 reads out from the storage section 42 the latest integrated operating time Td and controls the display drive section 44, in accordance with a blinking period determined by the read-out integrated operating time Td, to drive the first display section 53*a* so as to make the above-mentioned blinking display. It is assumed here that the period of the blinking display made by the first display section 53*a* depends on the read-out integrated operating time Td. After that, the control section 41 switches the first control portion 53*a* to the ordinary display mode for displaying ordinary operating states of the engine 20.

Figure 6:
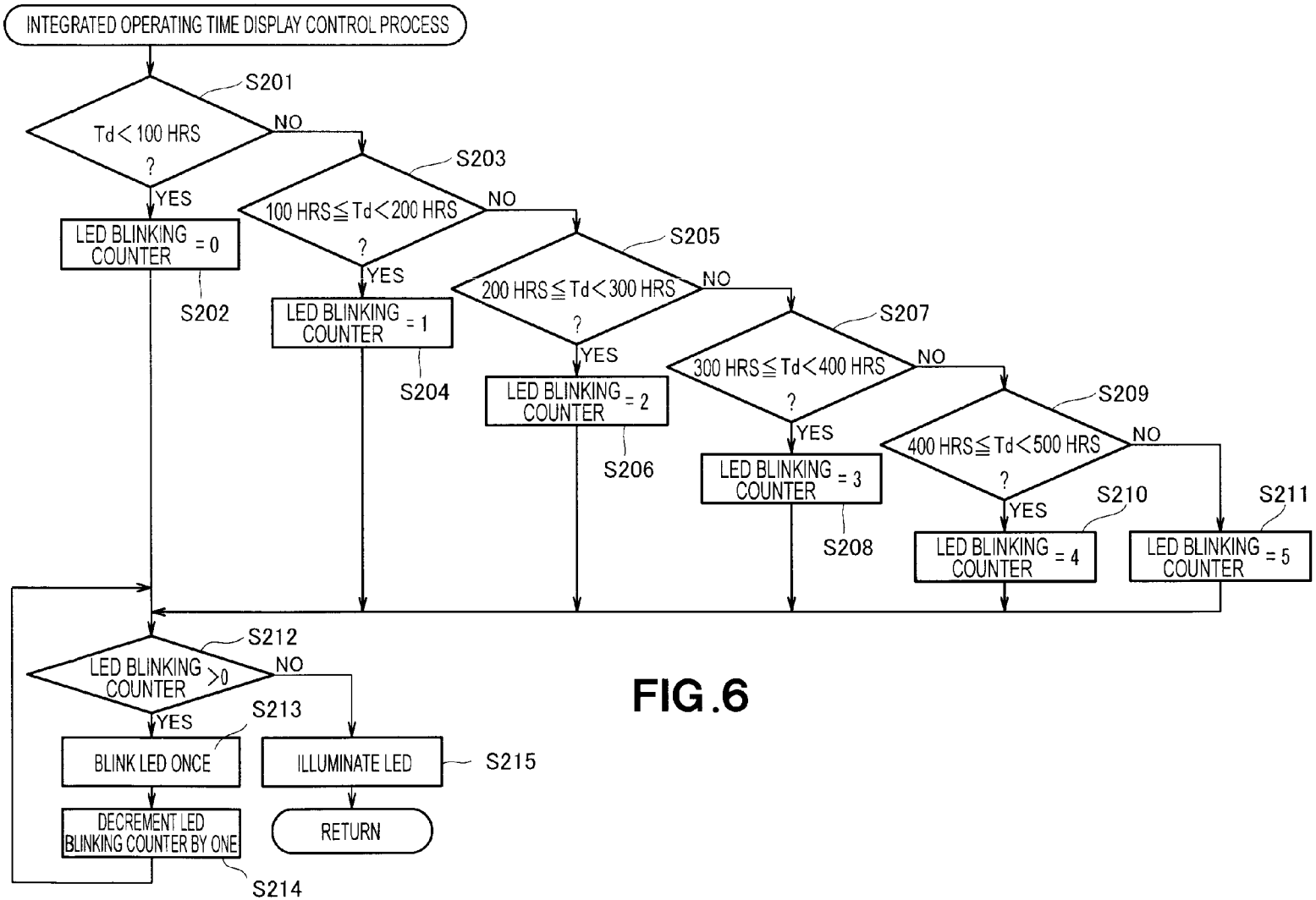
FIG. 6 is a flow chart of a subroutine for performing an integrated operating time display control process of FIG. 5.

FIG. 6 is a flow chart of a subroutine for performing the operations of steps S103, S110 and S113 of FIG. 5 (i.e., integrated operating time display control process). First, at step S201, the control section 41 compares the integrated operating time Td against a threshold value of "100 hours" preset for a no-blinking display (i.e., no-blinking display threshold value). If the integrated operating time Td is less than 100 hours as determined at step S201, control goes to step S202, where a value "0" is set into an LED blinking counter Cu (that is a counter allocated to the program executed by the control section 41). If, on the other hand, the integrated operating time Td is equal to or more than 100 hours as determined at step S201 (i.e., NO determination at step S201), control branches to step S203, where a further determination is made as to whether the integrated operating time Td is in a one-blinking display threshold value range from 100 hours to less than 200 hours.

If the integrated operating time Td is in the one-blinking display threshold value range (i.e., YES determination at step S203), a value "1" is set into the LED blinking counter Cu at step S204. If the integrated operating time Td is equal to or more than 200 hours (i.e., NO determination at step S203), control branches to step S205, where a further determination is made as to whether the integrated operating time Td is in a two-blinking display threshold value range from 200 hours to less than 300 hours.

If the integrated operating time Td is in the two-blinking display threshold value range from 200 hours to less than 300 hour (i.e., YES determination at step S205), a value "2" is set into the LED blinking counter Cu at step S206. If the integrated operating time Td is equal to or more than 300 hours (i.e., NO determination at step S205), control branches to step S207, where a further determination is made as to whether the integrated operating time Td is in a three-blinking display threshold value range from 300 hours to less than 400 hours.

If the integrated operating time Td is in the three-blinking display threshold value range from 300 hours to less than 400 hour (i.e., YES determination at step S207), a value "3" is set into the LED blinking counter Cu at step S208. If the integrated operating time Td is equal to or more than 400 hours (i.e., NO determination at step S207), control branches to step S209, where a further determination is made as to whether the integrated operating time Td is in a four-blinking display threshold value range from 400 hours to less than 500 hours.

If the integrated operating time Td is in the four-blinking display threshold value range from 400 hours to less than 500 hour (i.e., YES determination at step S209), a value "4" is set into the LED blinking counter Cu at step S210. If the integrated operating time Td is equal to or more than 500 hours (i.e. NO determination at step S209), control branches to step S211, where a value "5" is set into the LED blinking counter Cu at step S211.

Namely, after the control section 41 has performed the operation of any one of steps S202, S204, S206, S208, S210 and S211, it determines, at step S212, whether the value currently set in the LED blinking counter Cu is greater than "0". If the value currently set in the LED blinking counter Cu is greater than "0" (i.e., YES determination at step S212), the control section 41 controls the display drive section 44 to blink the first display section (LED) 53*a* once at step S213 and then subtracts a value "1" from the LED blinking counter Cu (i.e., Cu=Cu−1) so that the LED blinking counter Cu is updated at step S214, after which the control section 41 reverts to step S212. The control section 41 repeats the operations of steps S212 to S214 until the LED blinking counter Cu reaches a value "0".

Once the LED blinking counter Cu reaches the value "0" (i.e., NO determination at step S212), the control section 41 switches the display mode from the blinking display mode to the ordinary display mode so as to control the first display section 53*a* as an ordinary output display light and illuminate the first display section (LED) 53*a*, at step S215. After that, the subroutine of FIG. 6 is brought to an end, and control reverts to step S103, S110 or S113 of FIG. 4.

In the aforementioned manner, the control section 41 controls the number of blinks on the basis of the LED blinking counter Cu caused by the program to count each blinking operation.

Figure 7:
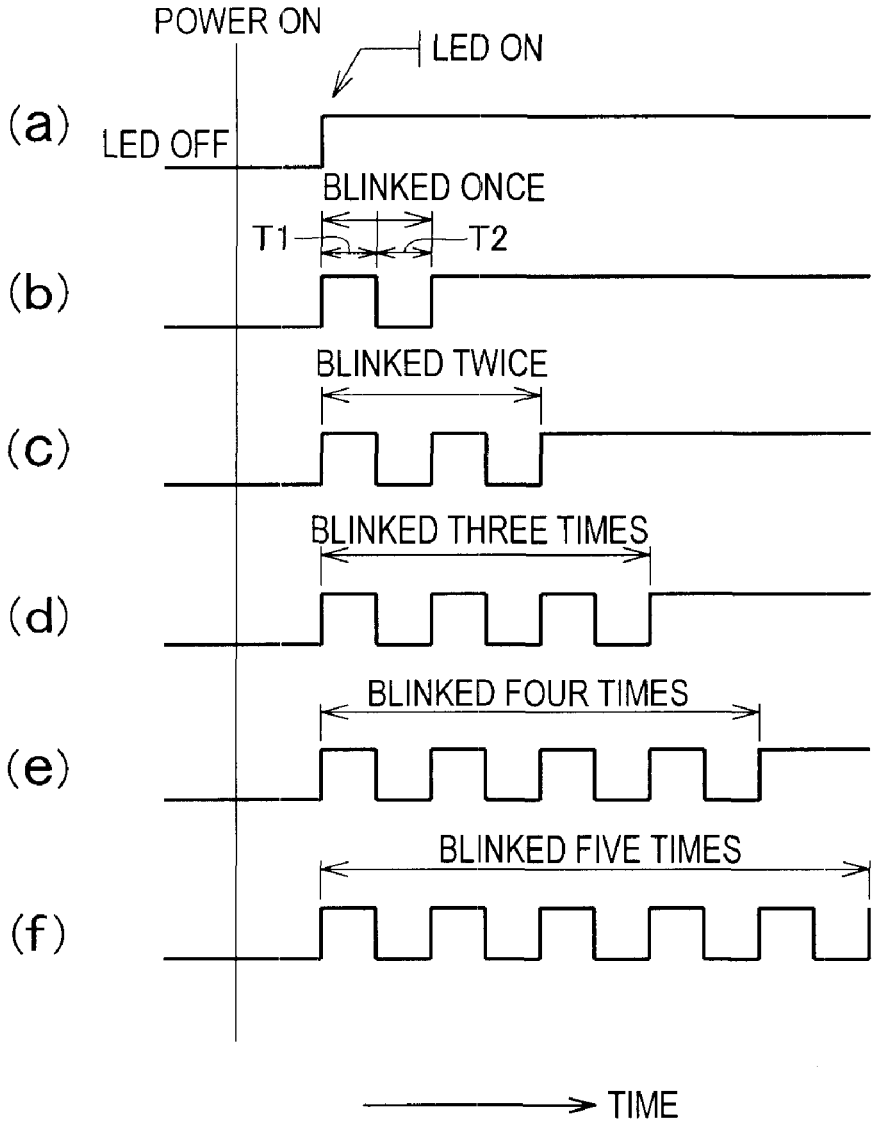
FIG. 7 is a diagram showing example control for six blinking patterns displayed by the display control process of FIG. 6.

With reference to FIG. 7, the following describe six blinking patterns executed in accordance with the flow chart of FIGS. 6. (a) to (f) of FIG. 7 each show a blinking pattern, corresponding to the integrated operating time Td, in pulses in a time-axis (horizontal-axis) direction. A duty ratio (T1/(T1+T2)) of the pulses may be set as desired; preferably, the duty ratio is set, for example, in a range of ½ to ⅔.

(a) of FIG. 7 shows a first blinking pattern executed when the integrated operating time Td is less than 100 hours; in this case, the first display section 53*a* is illuminated ordinarily without being blinked at all, upon establishment of predetermined conditions following activation of the engine 20. The first blinking pattern is executed by steps S202 and S212 to S215 of FIG. 6.

(b) of FIG. 7 shows a second blinking pattern executed when the integrated operating time Td is in the display threshold value range from 100 hours to less than 200 hours; in this case, the first display section 53*a* is blinked once. The second blinking pattern is executed by steps S204 and S212 to S215 of FIG. 6.

(c) of FIG. 7 shows a third blinking pattern executed when the integrated operating time Td is in the display threshold value range from 200 hours to less than 300 hours; in this case, the first display section 53*a* is blinked twice. The third blinking pattern is executed by steps S206 and S212 to S215 of FIG. 6.

(d) of FIG. 7 shows a fourth blinking pattern executed when the integrated operating time Td is in the display threshold value range from 300 hours to less than 400 hours; in this case, the first display section 53*a* is blinked three times. The fourth blinking pattern is executed by steps S208 and S212 to S215 of FIG. 6.

(e) of FIG. 7 shows a fifth blinking pattern executed when the integrated operating time Td is in the display threshold value range from 400 hours to less than 500 hours; in this case, the first display section 53*a* is blinked four times. The fifth blinking pattern is executed by steps S210 and S212 to S215 of FIG. 6.

(f) of FIG. 7 shows a sixth blinking pattern executed when the integrated operating time Td is equal to or more than 500 hours; in this case, the first display section 53*a* is blinked five times. The sixth blinking pattern is executed by steps S211 to S215 of FIG. 6.

The foregoing can be summarized as follows. The control section 41 monitors an operating time of the engine (internal combustion engine) 20 to acquire data of the integrated operating time Td and causes the first display section 53*a* of the display section 53 to blinkingly display the data of the integrated operating time Td. Namely, the first display section 53*a* is capable of displaying not only ordinary operating states of the engine 20 but also the integrated operating time Td. Thus, the instant embodiment can appropriately inform the user of the integrated operating time Td without requiring extra or additional equipment. Further, because there is no need to provide a separate member for informing of the integrated operating time Td, the instant embodiment not only can reduce cost of the engine 20 and power generator 30, but also can avoid design limitations of the engine 20 and power generator 30.

Further, after causing the first display section 53*a* to blinkingly display the data of the integrated operating time Td, the control section 41 switches the blinking display made by the first display section 53*a* to a display of previous operating states which the engine 20 was in immediately before the blinking display. Thus, the user does not have to perform any particular operation for switching the display (mode), which can enhance usability of the operation management apparatus.

Further, because the control section 41 causes the display section 53*a* to blinkingly display data of an integrated operating time Td of the engine 20 at the time of activation of the engine 20, the user can determine, at the time of activation of the engine 20, when maintenance, such as oil change, is to be performed, and thus, user-friendliness of the operation management apparatus can be enhanced.

Further, by the control section 41 causing the display section to blinkingly display data of an integrated operating time Td immediately after electric power necessary for operation of the control section 41 is secured and the control section 41 starts operating at the time of activation of the engine 20, the control section 41 can accurately inform the user of the integrated operating time Td of the engine 20. Thus, the instant embodiment can inform the user of an integrated operating time Td with an enhanced reliability.

Further, by the control section 41 causing the display section to blinkingly display data of an integrated operating time Td of the engine 20 at the time of deactivation of the engine 20, the user can determine when to perform maintenance, such as oil change, at the time of deactivation of the engine. Therefore, maintenance of the engine 20 can be performed at proper timing (based on the latest information of the integrated operating time Td) with an enhanced efficiency, as compared to the case where an integrated operating time of the internal combustion engine is displayed only at the time of activation of the engine.

Furthermore, by the control section 41 causing the display section to blinkingly display data of an integrated operating time Td immediately after electric power necessary for operation of the control section 41 is secured and the control section 41 stops operating at the time of deactivation of the engine 20 the control section 41 can accurately inform the user of an integrated operating time Td of the engine 20. Thus, the instant embodiment can inform the user of an integrated operating time Td with an enhanced reliability.

Furthermore, by the control section 41 causing the display section to blinkingly display data of an integrated operating time Td at least one predetermined time point during a time period from the activation to deactivation of the engine 20, the user can determine when to perform maintenance, such as oil change, during operation of the engine 20. Thus, in this case, the instant embodiment can achieve an even further enhanced flexibility and user-friendliness than in the case where an integrated operating time Td is displayed only at the time of activation or deactivation of the engine 20.

Embodiment 2

Figure 8:
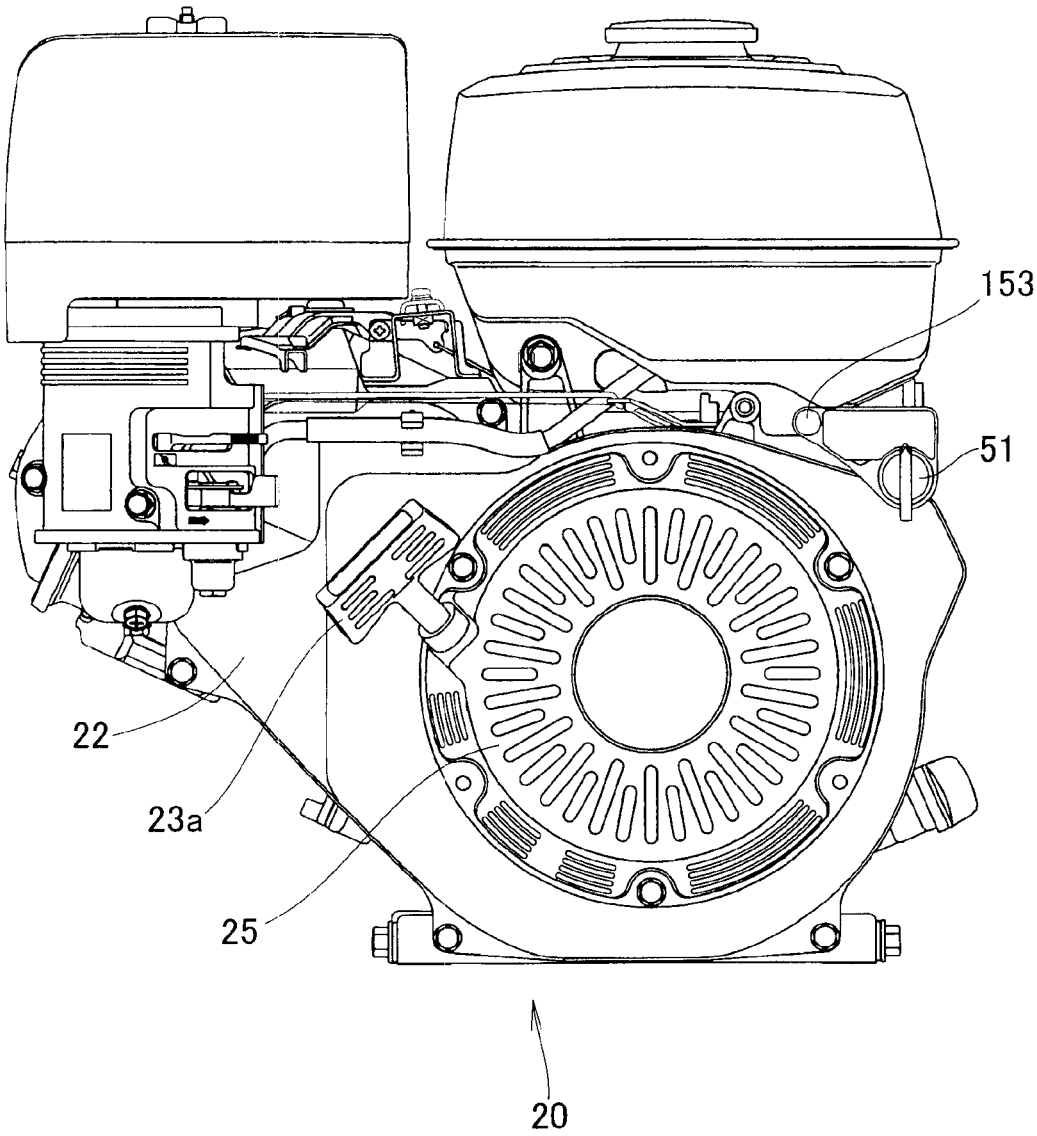
FIG. 8 is a view showing an outer appearance of a general-purpose engine provided with a second embodiment of the operation management apparatus.
Figure 9:
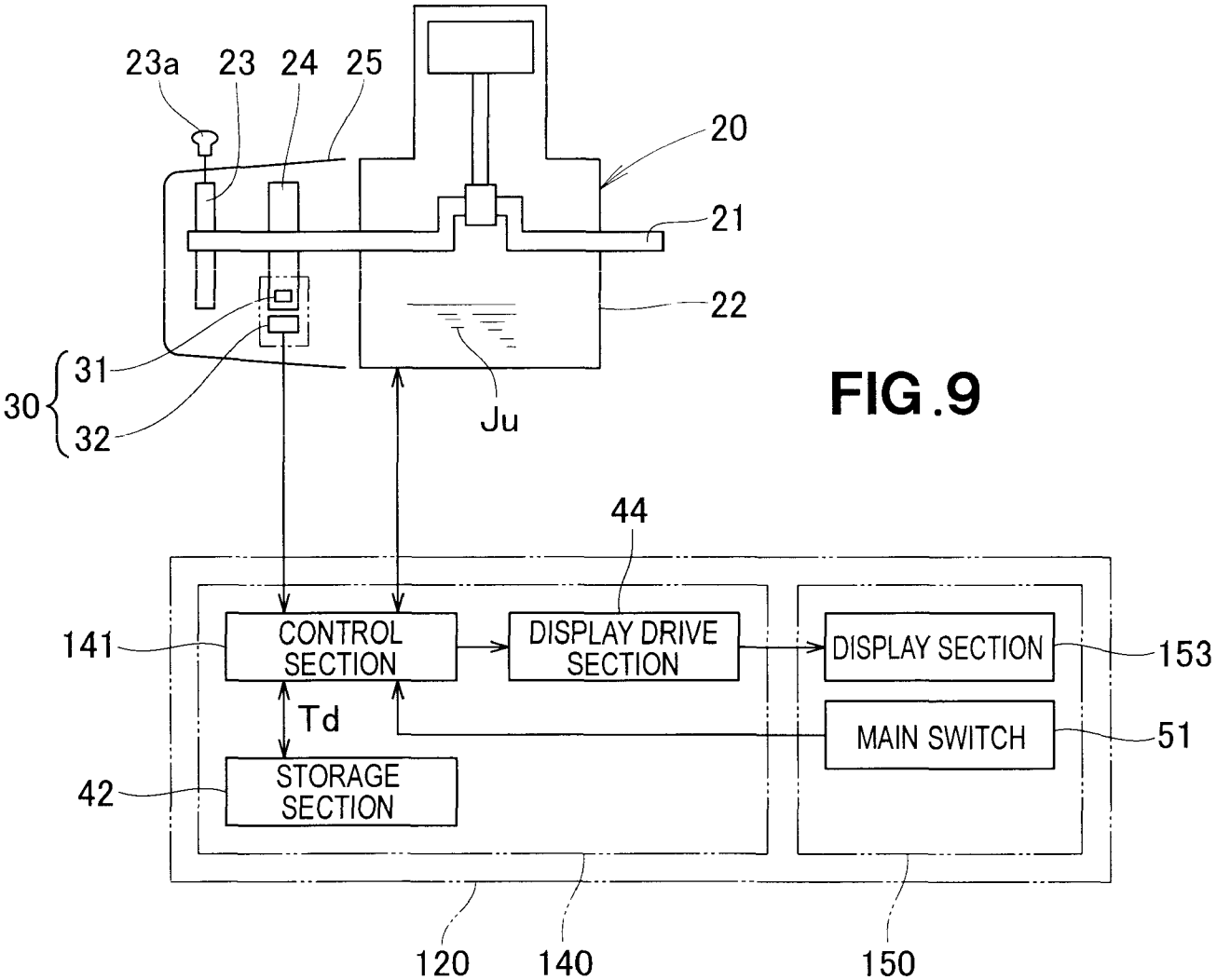
FIG. 9 is a block diagram showing a general setup of the general-purpose engine of FIG. 8.

Next, a description will be given about a second embodiment of the operation management apparatus of the present invention. FIG. 8 is a view showing an outer appearance of a general-purpose engine 20 provided with the second embodiment of the operation management apparatus 120, and FIG. 9 is a block diagram showing a general setup of the general-purpose engine 20 shown in FIG. 8. Elements substantially identical in construction and function to those in the first embodiment shown in FIGS. 1-7 are indicated by the same reference numerals as used for the first embodiment and will not be described here to avoid unnecessary duplication.

As seen from FIGS. 8 and 9, a fundamental construction of the general-purpose engine 20 employing the second embodiment 120 is substantially the same as the general-purpose engine 20 of FIG. 2 employing the first, embodiment and thus will not be described here to avoid unnecessary duplication. The crankshaft 21 extends outwardly from the crankcase 22 over a relatively great length. Various loads, such as a pulley and gear, are connected to the portion of the crankshaft 21 that extends outwardly from the crankcase 22.

The general-purpose engine 20 provided with the second embodiment includes a recoil starter 23, a power generator 30 and the operation management apparatus 120, of which the recoil starter 23 and power generator 30 are substantially the same as the recoil starter 23 and power generator 30 in the first embodiment shown in FIG. 2 and will not be described) here to avoid unnecessary duplication.

The operation management apparatus 120 includes an inverter section 140 and an operation panel section 150. The inverter section 140 includes a control section 141, a storage section 42 and a display drive section 44, and the operation panel section 150 includes a main switch 51 and a display section 153. As shown in FIG. 8, the main switch 51 and the display section 153 are provided on a side surface of the engine 20.

In the second embodiment, electric power generated by the power generator 30 is consumed only by the engine 20 itself and the operation management apparatus 120 and is not supplied to outside of the operation management apparatus 120. Thus, the operation management apparatus 120 does not include the inverter control power supply section 43 and outlet section 52 shown in FIG. 3. The control section 141 is substantially identical in construction to the control section 41 of the first embodiment, except that it does not include the inverter control power supply section 43 and outlet section 52. The display section 153 only need be substantively identical in construction to any one of the three display sections 53*a* to 53*c* shown in FIG. 1.

The same flow charts of FIGS. 4 to 6 described above in relation to the first embodiment are also applicable to the second embodiment, although not specifically described here. As apparent from the foregoing, the second embodiment achieves generally the same behavior and advantageous benefits as the first embodiment.

Note that the threshold values used at steps S201, S203, S205, S207 and S209 shown in FIG. 6 may be set at desired values rather than being limited to the values represented in 100 hours. Further, the display sections 53 and 153 may be constructed in any desired manner as long as they display operating states of the engine 20.

The operation management apparatus of the present invention is well suited for application to general-purpose engines, power generators provided with a general-purpose engine, and more particularly to output display lights of portable engine power generators.

What is claimed is:

1. An operation management apparatus for managing an integrated operating time of an internal combustion engine, the operation management apparatus comprising:

a control section for controlling operation of the internal combustion engine;

a storage section for storing data of the integrated operating time of the internal combustion engine monitored by the control section; and a display section capable of displaying not only an operating state of the internal combustion engine but also the integrated operating time of the internal combustion engine, the control section controlling the display section to make a blinking display with a predetermined number of blinks, corresponding to the integrated operating time, at predetermined timing.

2. The operation management apparatus of claim 1, wherein, after the display section has made the blinking display, the control section controls the display section to switch from the blinking display to a display of the operating state of the internal combustion engine.

3. The operation management apparatus of claim 1, wherein the predetermined timing at which the control section causes the display section to make the blinking display is a time point when the internal combustion engine is activated.

4. The operation management apparatus of claim 3, wherein a power generator is connected to the internal combustion engine, and wherein the predetermined timing at which the control section causes the display section to make the blinking display is a time point after the power generator starts generating electric power in response to activation of the internal combustion engine and the control section starts operating by being supplied with the electric power from the power generator.

5. The operation management apparatus of claim 1, wherein the predetermined timing at which the control section causes the display section to make the blinking display is a time point when the internal combustion engine is deactivated.

6. The operation management apparatus of claim 5, wherein a power generator is connected to the internal combustion engine, and wherein the predetermined timing at which the control section causes the display section to make the blinking display is during a time period when the power generator is generating electric power necessary for operation of the control section after the internal combustion engine receives an engine stop instruction.

7. The operation management apparatus of claim 1, wherein the predetermined timing at which the control section causes the display section to make the blinking display is at least one time point during a time period from a time point when the internal combustion engine is activated to a time point when the internal combustion engine is deactivated.

* * * * *